United States Patent [19]

Black

[11] 3,934,397

[45] Jan. 27, 1976

[54] WIRE ROPE SPLICE ASSEMBLY

[76] Inventor: Boyd C. Black, 1174 S. 30th St., Heath, Ohio 43055

[22] Filed: July 11, 1974

[21] Appl. No.: 487,539

[52] U.S. Cl. ..... 57/142; 57/159

[51] Int. Cl.[2] ..... B21F 15/04

[58] Field of Search ..... 140/111; 57/142, 159; 156/49; 29/461, 630 F; 403/275; 24/122.6; 289/1.2, 1.5

[56] References Cited

UNITED STATES PATENTS

| | | | |
|---|---|---|---|
| 2,943,434 | 7/1960 | Joy et al. | 57/159 |
| 3,286,452 | 11/1966 | Gathman | 57/142 |
| 3,295,309 | 1/1967 | Gathman et al. | 57/142 |
| 3,356,397 | 12/1967 | Bagby | 57/159 |
| 3,367,102 | 2/1968 | Meger | 57/142 |

FOREIGN PATENTS OR APPLICATIONS

| | | | |
|---|---|---|---|
| 271,345 | 1/1951 | Switzerland | 140/1 |

*Primary Examiner*—Lowell A. Larson
*Attorney, Agent, or Firm*—Charles F. Schroeder

[57] ABSTRACT

A wire rope or cable splice assembly particularly for long splices in wire ropes or cables for uphill and overhead transportation systems such as ski lifts, overhead cable rides and the like. Cable ends to be joined together in such assemblies are frequently spliced by cross tucking corresponding strands of opposite ends of the cable into the core space at spaced regions along the cable length, the number of such tuck regions corresponding to the number of strands in the exterior lay of the cable. The invention provides a novel assembly of a protective metallic sheath for the portion of each strand tucked into the core space, as well as a void filling back-up member for the void formed in the tuck region or zone of crossover of end portions of corresponding strands of spliced opposing cable ends.

10 Claims, 8 Drawing Figures

WIRE ROPE SPLICE ASSEMBLY

The present invention is related to splicing or wire ropes or cables, particularly for those used for uphill and overhead transportation systems and the like wherein strength and smoothness and an assured rope life are essential to safe and reliable operation of such systems.

With increasing traffic and use of uphill and overhead transportation systems such as ski lifts, amusement park skyrides and tour sightseeing rides, the need for safe, reliable and minimum maintenance of the wire rope and cabling which transmit the power as well as actually effecting the transport of passengers has become all the more important. Moreover, provision of strong splices, long life and smooth rides are of extreme importance in such transportation systems. The wire rope cables frequently convey passengers over the most rugged of terrains and replacement of cables is accordingly difficult, dangerous and desirably kept to a minimum.

The wire rope splice which constantly passes over the support sheaves of such systems, thus should conform uniformly over its length to the diameter of the main body and should be without bulges or recesses in the wire rope surface. The rope system is otherwise likely subject to vibrations and jerks in passage between towers and over numerous sheaves and about drive and take-up wheels during operation with consequent unnecessary shock stressing of the rope and shortening of the life of the wire rope, particularly in the splice region.

In view of the foregoing, it is an object of the present invention to provide a wire rope splice assembly and components which will enable provision of a strong connection of ends in conformity with the diameter of the main body of the rope to impart a smoothness in operation and to promote a longer rope life.

Another object of the invention is to provide a stable splice arrangement for wire ropes and cables having minimum or no recesses, indentations or bulges in the exposed rope surface.

Still another object of the invention is to provide a strong wire rope splice assembly wherein positive interengagement of the outer and inner strands in the splice region is promoted under loading.

Another and still further object of the invention is to provide a splice for wire ropes wherein weakness or damage due to abrasion between strands and the core as well as strand portions located in the core region are reduced to increase the life of such ropes in use.

In the prior art, where the usual wire rope has six strands helically laid about a core, it is well known to form a splice over a long length of the rope by pairing up oppositely extending ends of equal lengths of the rope and tucking three strands of each into spaced apart core regions of the other. Portions of the core of each end are removed for lengths correspondingly generally to the length of the strand end portions to be tucked therein. The outer strand portions to be tucked into the core region of the splice are covered or wound with cotton, duct, twine or friction tape to protect the strands against inter-abrasion in the tuck regions. Such protective materials, although providing a degree of protection and increased life, are particularly vulnerable to wear, breakdown and deterioration, not only because of stresses of heavy loading and working as by flexing and twisting and abrasion in use, but also because of the extreme weather and other environmental conditions to which such ropes and cables are frequently subjected.

The splice in a wire rope or cable is usually the poorest portion since any distortion in the region causes a greater working of the material in the splice region than the remainder of the rope thereby promoting a progressive weakening of the splice. According to the present invention where long splices are made such as by tucking a length of each strand end individually into the core region of the wire rope, each such strand end is enclosed in a continuous tubular sheath to fill the space left by removal of the core and to protect the strands in the tuck region against wear.

The center of core region of a wire rope is usually a little larger than the diameter of the outer strand and voids are presented when an outer strand is inserted in the core region. Where the wire rope is the usual steel rope, a protective and filling sheath about the tucked portion of steel strand is desirably of bearing type material such as copper, aluminum, lead and alloys thereof or synthetic resin material such as nylon which will be compatible in wear resistance which although not fully understood is believed to be provided by a cushioning action which reduces scarfing and frictional abrasion between the center and outer steel strands. Also when such tubing is placed around the strand in the core region, lubrication materials in the strand are locked in which not only assures prolonged lubrication but reduces the possibilities of dry rust from forming.

The metal of the strand enclosing sheath is preferably made different in hardness from that of the wire rope. It is well known that dissimilar materials such as steel and bronze are more compatible in frictional relation, as in a bearing than one material against itself such as steel on steel in frictional engagement. This combination of a hard surface metal and a contacting softer bearing type material surface results in an excellent bearing interface combination and this property is embodied in the present invention to reduce the effects of abrasion in the splice region.

Another aspect of the invention is that where a void is formed such as at each point of crossover or intersection between two strands tucked into the core region of the wire rope, a filler member is provided to back up the strand portions in the region to contribute to conformity of the strands to the exterior dimension and shape of the rope at each of the splice intersections. The filler and back-up member it is found lessens distortion of the strands in the crossover regions and promotes longer life of the wire rope in the spliced region. Like the sheath member, the filler member may be of metal such as copper, aluminum, lead or alloys thereof or resinous material such as nylon which will act compatibly to reduce results from abrasion with steel strands of the rope.

Other objects and features which I believe characteristic of my invention are set forth with particularity in the appended claims. My invention, however, both in organization and manner of construction, together with further objects and features thereof, may be best understood by reference to the following description taken in connection with the accompanying drawings wherein:

Figure 1:
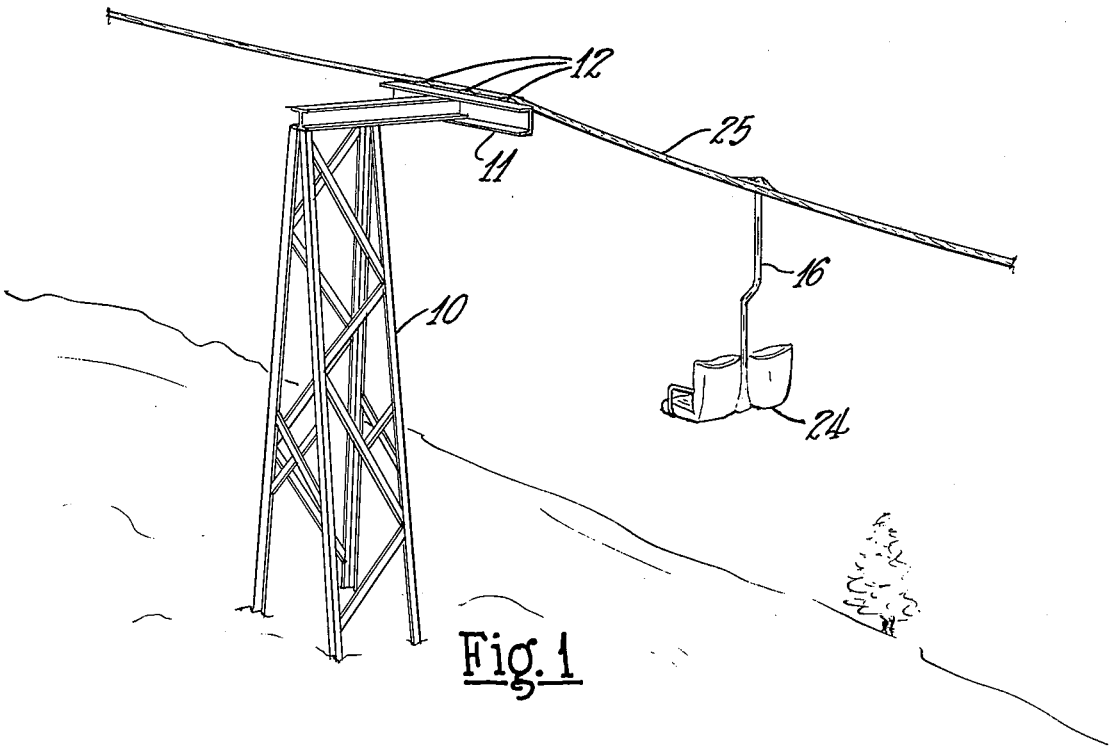
FIG. 1 is a general overall view of a portion of an uphill wire rope or cable transportation system such as a ski lift in which the protective splice members and splice assembly of the present invention may be advantageously utilized.

Referring to the drawings in greater detail, FIG. 1 illustrates a ski lift representative of an uphill transportation system wherein a spliced cable or wire rope is passed over a series of sheaves for uphill conveyance of passengers. A rope support 11 extending laterally from a tower 10 incorporates a series of sheaves 12 over which a wire rope 25 passes. A series of chairs, represented by a double chair 14 are each supported from its respective bar 16 secured to and hanging from the wire rope 25. The longer the upward incline, the greater the number of sheaves the wire rope is required to pass over and correspondingly the greater the loading and working on the wire rope in conveying passengers uphill. Strength and uniformity of the splice in the wire rope accordingly is all the more important to long life and safety of the entire system.

The ski lift of FIG. 1 is representative of a number of uphill and overhead transportation systems utilizing wire ropes and cables in which the protective splice members and splice assembly of the present invention may be particularly advantageously utilized. Chairlifts, T-bar lifts, sky rides tramways and other transportation systems utilizing wire ropes or cables for power transmission and passenger conveyance are all of a type in which safety is of extreme importance as imparted by the structural features of the present invention.

Figure 2:
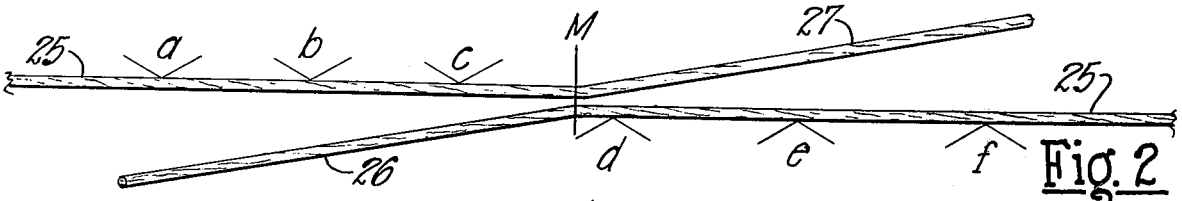
FIG. 2 shows two ends of a wire rope to be spliced with a "V" designating each of the regions along the length of the main body of the rope at which a strand of one end is to be crossed with a corresponding strand of the other end tucked into the core region of the other end of the rope.

FIG. 2 illustrates the manner in which a long splice can be made of two ends 26 and 27 of the wire rope 25 in which the protective components of the present invention lend themselves particularly to imparting safety and a longer life of such a splice assembly. The opposite ends 26 and 27 of the wire rope are first unwound and the fibrous core sections are removed therefrom. Commercial wire ropes usually have six strands distributed helically about a core of metal or of fiber. The point M at which the two ends 26 and 27 are unwound to free the strands for subsequent weaving into a splice is termed the marriage point. Three of the strands of each end are cut back to predetermined points beyond the marriage point leaving three free strand ends to be mated with corresponding strands at the spaced tuck positions *a*, *b*, *c* and *d*, *e* and *f* of wire rope 25. In tucking an end portion of a strand into the core region of the wire rope, a dagger tool is used to form an opening between strands. A tucker tool is placed in the opening between the strands and the fiber core is removed with a pair of pliers as the tucking progresses. The corresponding strands of the opposite ends of the rope are mated in each of these tuck positions by being crossed over and inserted in the core space of the other end of the rope.

Figure 3:
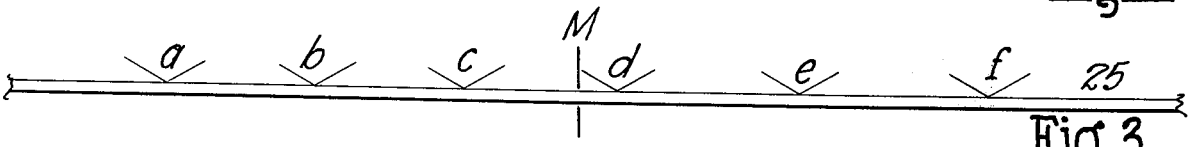
FIG. 3 shows a fully spliced rope marked as in FIG. 2 to illustrate the regions of crossover and tucking of strands into the rope core region.

FIG. 3 illustrates the spliced rope 25 and the tuck positions or regions *a*, *b* and *c* on one side of the marriage point M and positions *d*, *e* and *f* on the other in which crossovers of corresponding pairs of strands are effected and tucked into the core space of the rope.

Figure 4:
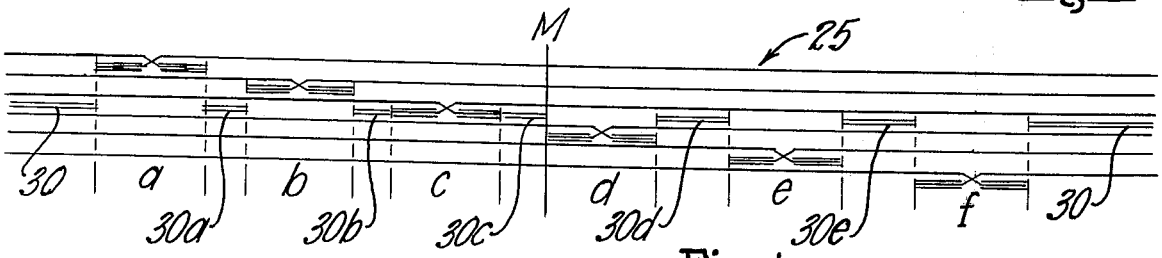
FIG. 4 is a schematic layout of the strand and core arrangement of the spliced rope of FIG. 3 illustrating the location of protective sheaths over each tucked strand end and intermediate core sections of the rope.

FIG. 4 illustrates in plan view the arrangement of the corresponding strand ends in each of the tuck regions of FIG. 3 and illustrates how the strand layout pattern would appear if the helically oriented strands in the splice region were unwound and laid out flat on either side of the core strand 30 of the rope. The oppositely tucked ends of corresponding strands of the two ends are shown more clearly in the tuck regions *a*, *b*, *c*, *d*, *e* and *f* of the long splice with portions of the original core 30 remaining in between the tuck regions as shown at 30*a*, 30*b*, 30*c*, 30*d* and 30*e* respectively. Three of the tuck regions are on one side of the marriage point M and three on the other side.

According to the present invention each end of the pair of strand ends in the six tuck regions is covered with a metal tubing. Each tube encompasses a strand end for substantially its full length in the tuck region. Copper tubing has been found to function admirably in protecting tucked strands of spliced steel wire ropes and as shown in FIG. 5 the tubing is provided with a slit along its full length to permit it to be opened such as with pliers and then clamped in surrounding relation about the strand end.

Figure 5:
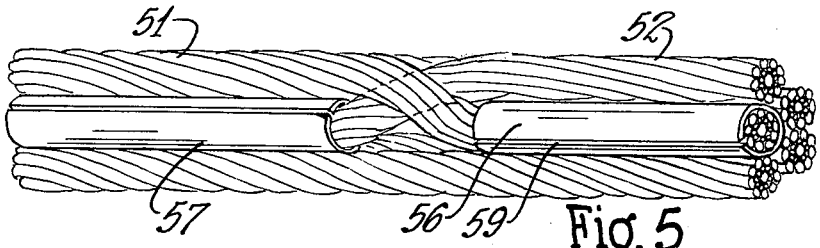
FIG. 5 is an enlarged view of a strand crossover region of the spliced cable with two strands of the rope deleted to illustrate more clearly the location of the protective strand sheaths of the invention.
Figure 6:
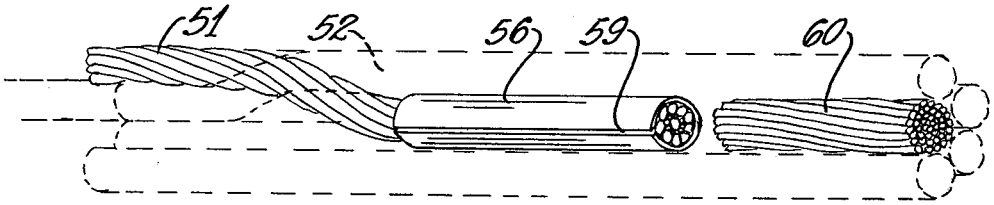
FIG. 6 is a slightly longer view of the crossover region of FIG. 5 with deleted strands shown in dotted lines and showing the manner in which the sheathed strand portion is aligned with and extends to the core portion of the rope.

FIG. 5 illustrates the crossover and tuck region of the splice with two of the six strands of the rope removed. Strands 51 and 52 are crossed and their ends are enclosed in copper tubes 56 and 57 respectively. The tubing 56, as illustrated more clearly in FIG. 6, is arranged to be the same diameter as the core 60, portions of which were removed to make space for insertion of the strand 51 with the enclosed copper tubing 56 therein. The copper tubing is slit such as with a saw and is then opened and clamped about the strand 56 and inserted in the core region in alignment with the original core of the wire rope. The wall thickness of the tubing is selected to fill the space left after removal of the core, but not so thick as to cause the outer strands to bulge nor the tucked ends to be excessively stiff. For example, for a 1½ inches diameter wire rope, strands have a diameter of approximately ⅜ inch and a copper tubing having an OD of ½ inch may be used. The wall thickness of commercial tubing of this size is usually 3/64 inch.

The gap 59 of the tubing 56 is made to be sufficiently wide that after being clamped around the strand, the confronting edges of the tube do not contact each other and are sufficiently far apart that after a period of use of the wire rope in which it is inserted, the tube can close still tighter about the strand under the lateral forces applied thereto by the outer strands upon application of tension forces to the wire rope. After initial clamping of the tubing about the strand, however, the gap 59 is preferably not so wide that wire filaments of the strand can pass therethrough, and in this regard, the gap is usually preferred not to be greater in width in its clamped condition than the diameter of a filament of the strand portion which it holds enclosed.

Where a wire rope provided with a splice of the type illustrated is placed in tension, such as in an uphill lift, the tension causes the outer strand to bear tighter against the surfaces of the interior tubing surrounding the strand portions in the tucked region. Accordingly after a period of use, the surface of the tubing can become indented slightly in conformation with the filaments bearing against the tube, thereby establishing a better grip between the outer strand with the portion of strand in the tuck region, both causing a more positive mechanical engagement therewith and tighter clamping of the tubing about the portion of the strand which it encloses. Since the friction of the tucked strands is the holding strength of the splice, metal sheaths covering the tucked strand lengths serve to add tensile resistance to the splice, thus not only adding strength but more deterioration resistant life to the splice.

Figure 7:
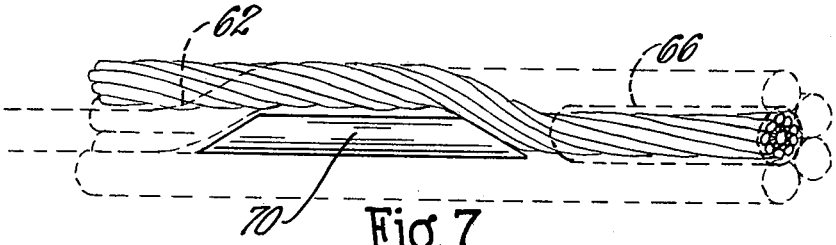
FIG. 7 is a view of a strand crossover region of a rope splice as illustrated in FIGS. 2–6 showing a protective filler and back-up member of the present invention located in and conforming in general shape to the space formed in the strand crossover region.

FIG. 7 shows another aspect of the invention wherein a backup member 70, such as of metal like copper, is inserted in the void in the splice region below the crossover of two strands 61 and 62 of the wire rope. At the point of intersection of the two strands tucked on the inside of the wire rope there is a void space. A length of solid metal rod or a rod of resinous material like nylon having oppositely inclined ends and corresponding generally to the length of the void is inserted in the void to fill the space. This filler and backup member is shown in FIG. 7 in a somewhat extended sense to illustrate more clearly how it functions. Member 70 contributes to the conformity of the wires to the diameter of the rope at the strand intersections of the splice. The addition of this filler member results in much less distortion and longer wire rope life in the spliced region in comparison to splice assemblies where the void space is allowed to remain unfilled.

Figure 8:
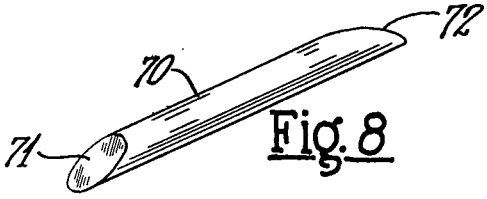
FIG. 8 is a perspective view showing in more detail the filler and back-up member of FIG. 7.

FIG. 8 illustrates the combination filler and backup member 70 in perspective showing the beveled or inclined ends 71 and 72 illustrating more clearly that it can be ciruclar and is made to conform generally to the space under the crossing rope strands 61 and 62 in alignment with the core space including the tubing 66 surrounding the strand in the tuck region.

The length of the filler backup member may be approximately half the length of lay of strand in the helical configuration of the wire rope. For example, if the lay is approximately 7½ inches, the length of the backup member may be about 3 inches to fill in the voids below the crossover space of the tuck position. Still further, the member 70 for a 1⅛ inches diameter rope may be 3 inches long and have a diameter of ⅜ inch which matches generally that of the strands in the wire rope. Although member 70 is herein shown as being in the crossover region in alignment with the strand section surrounded with protective tubing 66, it will be recognized that it may also be utilized advantageously in splice arrangements without the use of the protective tubing about the tucked in strand portions. After a period of use of a spliced cable, the backup member 70, like the tubing 10, also is locked in place more tightly within the core space of the crossover region. This in turn causes a more positive holding of the strand portions in the core regions after a period of use of the spliced wire rope.

While I have shown particular arrangements of my invention, it will be understood that I do not wish to be limited specifically thereto since many modifications may be made within the broad concepts of the invention. I therefore contemplate by the appended claims to cover all modifications that fall within the true spirit and scope of my invention.

I claim:

1. In a wire rope splice wherein a length of an end portion of at least one outer strand of the rope is tucked into the central core region of the rope;

a protective tubular sheath of material compatible in wear resistance with the wire rope material surrounding substantially the full length of said tucked end portion of strand of size such as to fill the core space without increasing the diameter of the rope in the splice region over that of the main body of the rope.

2. A wire rope splice as set forth in claim 1 wherein a length of the end portion of each outer strand of the rope is tucked into the core region replacing the core in a region of the splice spaced linearly from each of the other tucked strand ends and a separate protective tubular sheath surrounds the full length of each of said tucked strand ends.

3. A wire rope splice as set forth in claim 2 wherein each protective sheath comprises a length of metal tubing encompassing its respective strand in compressing relation.

4. A wire rope splice as set forth in claim 3 wherein the protective sheaths each have a slit through the wall of said metallic tubing extending for the full length of said tube permitting opening and closure of said tube about said strand.

5. A wire rope splice according to claim 4 wherein the distance across the gap of the slit in said tube is not greater than the diameter of wire members of the strand which it encompasses.

6. A wire rope splice as set forth in claim 1 wherein the protective sheath comprises a copper tube encompassing substantially the full length of the portion of said strand in the core region.

7. A wire rope splice as set forth in claim 1 wherein the protective sheath comprises a nylon tube encompassing substantially the full length of the portion of said strand in the core region.

8. A steel wire rope wherein at least one length portion of an outer strand extends through the central region of the rope taking the place of the core of the rope for said length, said length portion being enclosed in clamped relation in a protective sheath of metal compatible in wear resistance with the steel of said rope.

9. A steel wire rope according to claim 8 wherein said sheath comprises a copper tube encompassing substantially the full length of the portion of said strand in the core region.

10. In a wire rope splice assembly wherein lengths of mated end portions of strands of spliced rope ends are crossed and the mated end portions are tucked in opposite directions into the core region of said rope, a longitudinal filler member shaped to fill in the central void underlying the crossover region of said mated end portions, and a separate protective sheath of material compatible in wear resistance with the wire of said rope surrounding the full length of each of said tucked strand ends.

* * * * *